United States Patent [19]

Kato et al.

[11] Patent Number: 4,975,077

[45] Date of Patent: Dec. 4, 1990

[54] ELECTRICAL CONNECTOR

[75] Inventors: Tetsuo Kato; Masakuni Samejima, both of Haibara, Japan

[73] Assignee: Yazaki Corporation, Tokyo, Japan

[21] Appl. No.: 435,934

[22] Filed: Nov. 14, 1989

[30] Foreign Application Priority Data

Nov. 30, 1988 [JP] Japan ..... 63-154867[U]

[51] Int. Cl.[5] ..... H01R 4/24

[52] U.S. Cl. ..... 439/395

[58] Field of Search ..... 439/389, 391, 395, 396, 439/397, 399, 400, 401, 406, 407, 408, 417, 418, 419, 426

[56] References Cited

U.S. PATENT DOCUMENTS

| | | | |
|---|---|---|---|
| Re. 31,132 | 1/1983 | Hoppe, Jr. | 439/406 |
| 4,533,193 | 8/1985 | Blackwood | 439/408 |
| 4,653,830 | 3/1987 | Pegram | 339/97 |

FOREIGN PATENT DOCUMENTS

| | | |
|---|---|---|
| 58-182269 | 12/1983 | Japan . |
| 1485129 | 9/1977 | United Kingdom . |

*Primary Examiner*—Joseph H. McGlynn
*Assistant Examiner*—Hien D. Vu
*Attorney, Agent, or Firm*—Venable, Baetjer and Howard

[57] ABSTRACT

A pressure contact electrical connector adapted to connect an electric wire by inserting it in a slit of a terminal thereof comprises stripper portions formed on the inlet side of the slit and adapted to strip the insulating coating of the wire; a wide portion extending from the ends of the stripper portions; contact pieces projecting outwardly from the terminal body opposite to the wide portion, the contact pieces being bent back so as to allow the leading ends thereof to be inserted into the wide portion of the slit without contacting the terminal body; and electric wire connecting portions formed continuously with the coating stripper portions.

2 Claims, 2 Drawing Sheets

ELECTRICAL CONNECTOR

BACKGROUND OF THE INVENTION

1. Field of the Invention

This invention relates to a pressure contact electrical connector which can be used to connect therewith plural kinds of electric wires having different diameters.

2. Description of the Prior Art

Pressure contact electrical connectors have become widely used, since connection of an electric wire with the terminal thereof can be made easily only by thrusting the electric wire into the slit of the terminal. However, because the width of the slit of such a connector is normally predetermined, it can be used only for electric wires having a diameter corresponding to the width of the slit. Therefore, it was required to provide many kinds of pressure contact electrical connectors adapted for use with the diameters of electric wires to be connected, thus posing a problem in that production and management become unavoidably complicated.

To solve the above-mentioned problem, a pressure contact electrical connector has been proposed in Japanese Laid-Open patent application No. SHO. 58-182269. The electrical connector disclosed therein has three slits of different widths formed therein so that three lengths of electric wires whose diameters correspond to the respective widths of the slits can be pressed into contact with the connector.

However, this conventional pressure contact electrical connector requires provision of a terminal whose length corresponds to the total length of the three pieces of the electric wires to connect one length of the electric wire therewith. Therefore, this electrical connector has been disadvantageous in that the size of the connector becomes inevitably large thus necessitating a large space for the installation thereof.

The present invention has been made in view of the above-mentioned circumstances in the prior art, and has for its object to provide a pressure contact electrical connector which enables plural kinds of electric wires having different diameters to be pressed into contact therewith and which requires less space for the installation thereof.

SUMMARY OF THE INVENTION

To achieve the above-mentioned object, according to the present invention, there is provided a pressure contact electrical connector for connecting electric wires, formed by punching a metallic plate material and bending the same; comprising a terminal having a slit being opened at the leading end thereof, and a terminal connecting portion formed on the opposite side of the terminal; the slit having coating stripper portions formed at the inlet and adapted to strip the insulation coating of the electric wire, and a wide portion formed continuously with the ends of the coating stripper portions; the terminal having contact pieces projecting outwardly opposite to the wide portion, the contact pieces being bent back so as to allow the leading ends thereof to be inserted into said wide portion without contacting the body of the terminal, the resultant outer surfaces of the contact pieces forming electric wire connecting portions adjacent to the coating stripper portions.

The function of the pressure contact electrical connector of the present invention is as follows:

An electric wire is thrust into the terminal from the inlet of the slit, and its insulating coating is stripped by the stripper portions to expose the conductors thereof. Since the thrusting force F is continuously applied, the conductors are inserted in between the electric wire connecting portions and pressed into contact with the contact pieces thereby making an electrical connection between them. Since both the contact pieces are spaced away from the terminal, they can be elastically deformed with changes in diameter of the wire to be connected thus enabling the spacing between them to be varied so that electric wires having various diameters can be pressed into contact therewith.

As described hereinabove, since in the pressure contact electrical connector of the present invention, the electric wire connecting portions are formed by resilient members and the spacing between them is variable with the diameter of an electric wire to be connected, the connector itself can be made compact, and the use of one kind of such a connector enables plural kinds of electric wires having different diameters to be pressed into contact therewith. Thus, the present invention provides the effect of reducing the kinds of connectors required to be used.

DETAILED DESCRIPTION OF THE INVENTION

Figure 1:
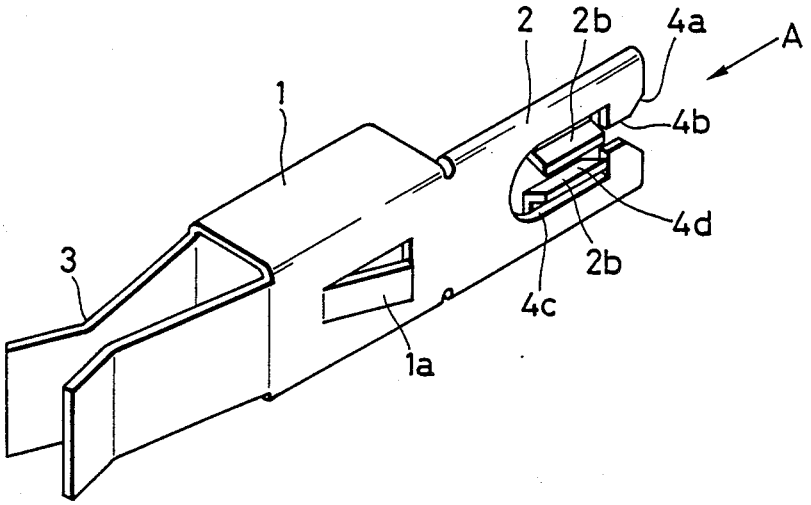
FIG. 1 is a perspective view of an embodiment of a pressure contact electrical connector according to the present invention.

The present invention will now be described below by way of example only with reference to the accompanying drawings. FIG. 1 is a perspective view of the whole electrical connector according to the present invention. The electrical connector A is formed by punching a plate material of a metal such as brass or the like and bending it, and comprises a body portion 1, a terminal 2 serving as an electric wire connecting portion, and a terminal connecting portion 3 adapted to be connected with a terminal of another electric wire.

The body portion 1 is formed by bending a plate material in a prismatic shape, and has engaging pieces 1 a formed on both sides thereof, which are each formed by punching the plate material to form a rectangular piece and pulling out the three sides of the piece so as to project from the surface of the body.

The terminal connecting portion 3 is formed by bending inwardly the extensions of the two opposite side walls of the body portion 1 and is arranged such that a terminal of another electric wire is fitted in between the side walls thereof thereby electrically connecting the wire therewith by the resiliency thereof.

Figure 2:
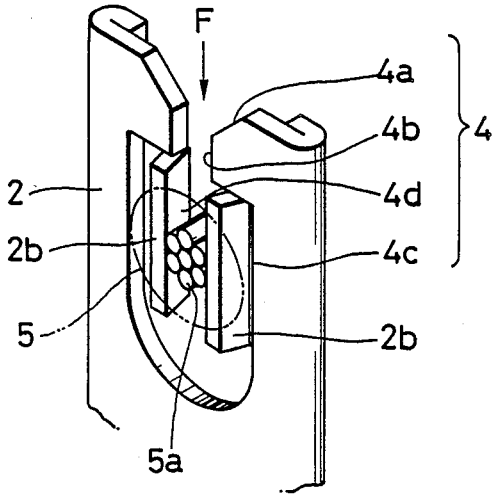
FIG. 2 is a perspective view of a terminal of the electrical connector.
Figure 3:
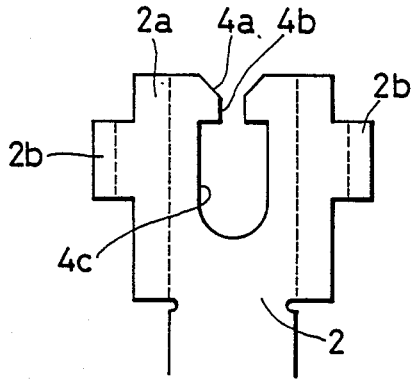
FIG. 3 is a developed view of the above-mentioned terminal.
Figure 4:
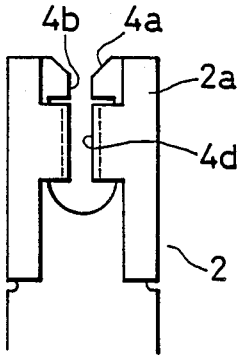
FIG. 4 is a front view of the terminal after the fabrication thereof.

The construction of the terminal of the connector forming the principal part of the invention will now be described below. FIG. 2 is a perspective view of the terminal of the electrical connector. FIG. 3 is a developed view of the terminal. FIG. 4 is a front view of the terminal after the fabrication thereof. The terminal 2 is likewise formed by the extension of one side wall of the body portion 1, and has a slit 4 formed therein so as to open at the leading end thereof. The inlet of the slit 4 is defined by tapered portions 4*a* which are formed to facilitate insertion of an electric wire in the slit. The tapered portions 4*a* are followed by stripper portions 4*b* which are adapted to strip the insulating coating of the electric wire. The above-mentioned construction of the slit 4 is identical to that of the slit of the prior art connector. Further, a wide portion 4*c* extends from the end of the stripper portions 4*b* of the slit 4. The terminal 2 has on both the outer sides thereof elongations 2*a*, and contact pieces 2*b* extending therefrom opposite to the above-mentioned wide portion 4*c*. Each of the elongations 2*a* is bent back in a U-shape along each of the bend lines, which align substantially with the edges of one side wall of the body portion 1. The leading ends of the contact pieces 2*b* are inserted in the wide portion 4*c* and spaced apart from the terminal 2. The leading ends of the contact pieces 2*b* form electric wire contacting portions 4*d* having a spacing therebetween which is nearly the same as that of the stripper portions 4*b* and which are kept apart from he wide portion 4*c* of the slit 4 and adjacent to the stripper portions 4*b*. The spacing between the electric wire contacting portions 4*d* is expansible by the resiliency of the contact pieces 2*b* until the same are abutted against the edge of the wide portion 4*c*. Such being the construction, the size of the electrical connector according to the present invention can be made smaller than that of the conventional connector. Further, the elongations 2*a* are provided for reinforcement purposes and may be omitted according to conditions such as the thickness of the plate of the terminal 2, etc.

The function of the above-mentioned electrical connector will be described below.

In FIG. 2, an electric wire 5 is placed in the tapered portions 4*a* forming the inlet of the slit 4 and thrust into the slit 4 by applying a force F in the direction shown by an arrow. The outside diameter of the electric wire 5 is shown by a dotted-chain line. The insulating coating of the electric wire 5 is stripped by the stripper portions 4*b* to expose conductors 5*a* thereof. Since the force F is continuously applied, the conductors 5*a* are thrust in between the electric wire contacting portions 4*d* and pressed into contact with the contact pieces 2*b* thereby making an electrical connection between them.

Figure 5:
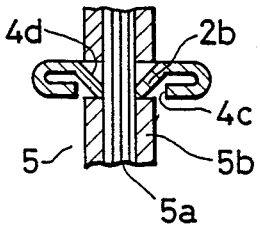
FIG. 5 is a sectional view showing a condition of a thin electric wire pressed into contact with the above-mentioned terminal.
Figure 6:
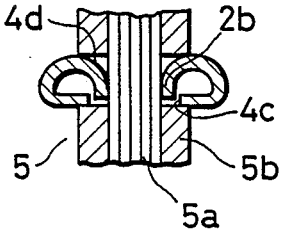
FIG. 6 is a sectional view showing a condition of a thick electric wire pressed into contact with the above-mentioned terminal.

FIGS. 5 and 6 shows cases where electric wires having different diameters are connected by the connector of the present invention. FIG. 5 shows a case where a thin electric wire is connected. In this case, the spacing between the electric wire contacting portions 4*d* is expanded somewhat by the insertion of the electric wire, and the contact pieces 2*b* are spaced apart from the edge of the wide portion 4*e* of the terminal 2. Reference numeral 5*b* denotes the insulating coating of the electric wire. FIG. 6 shows another case where a thick electric wire is connected. In this case, the spacing between the electric wire connecting portions 4*d* is expanded to such a degree that the contact pieces 2*b* are brought into contact with the edge of the wide portion 4*c* of the terminal 2. In this manner, the spacing between the electric wire connecting portions 4*d* is adjusted by the resiliency of the contact pieces 2*b* in accordance with the diameter of the electric wire to be pressed in contact therewith.

It is to be understood that the foregoing description is merely illustrative of a preferred embodiment of the present invention, and that the scope of the invention is not to be limited thereto, but is to be determined by the scope of the appended claims.

What is claimed is:

1. A pressure contact electrical connector for connecting electric wires, formed by punching a metallic plate material and bending the connector, comprising: a terminal having a leading edge and a terminal connecting portion formed on an opposite side of said terminal; said terminal including a slit having an inlet open at said terminal leading edge, said slit having a wide portion and coating stripper portions formed at the slit inlet that are adapted to strip the insulating coating of an electric wire, said wide portion being formed continuously with the ends of said coating stripper portions, said terminal having a pair of generally opposed electric wire contact pieces that project outwardly from a plane defined by the slit wide portion, said contact pieces being bent back so as to allow leading ends thereof to be inserted into said wide portion without contacting the body of the terminal, outer surfaces of the contact pieces following bending, thereby forming electric wire connecting portions adjacent to the coating stripper portions.

2. A pressure contact electrical connector according to claim 1, wherein said terminal comprises a reinforcing extension that is interposed between the body of the terminal and each of said contact pieces for reinforcing the terminal adjacent the slit.

* * * * *